US005404985A

United States Patent [19]

Baughman

[11] Patent Number: 5,404,985

[45] Date of Patent: Apr. 11, 1995

[54] METHOD AND APPARATUS FOR ELECTRONICALLY RECOGNIZING AND COUNTING COINS

[76] Inventor: Robert W. Baughman, 46972 Foxtail Ct., Mt. Clemens, Mich. 48044

[21] Appl. No.: 49,013

[22] Filed: Apr. 16, 1993

[51] Int. Cl.[6] ..... G07F 5/02; G07F 5/10

[52] U.S. Cl. ..... 194/242; 194/244

[58] Field of Search ..... 194/242, 244, 337, 217, 194/239, 240, 241

[56] References Cited

U.S. PATENT DOCUMENTS

| | | | |
|---|---|---|---|
| 2,973,074 | 2/1961 | Haverstick | 194/244 |
| 2,990,930 | 7/1961 | Melvin | 194/242 |
| 3,797,307 | 3/1974 | Johnston | 73/163 |
| 4,216,461 | 8/1980 | Werth et al. . | |
| 4,228,885 | 10/1980 | Cavalleri | 194/242 |
| 4,234,071 | 11/1980 | Le-Hong . | |
| 4,509,633 | 4/1985 | Chow | 194/100 A |
| 4,845,484 | 7/1989 | Ellsberg . | |
| 4,967,895 | 11/1990 | Speas | 194/244 X |
| 5,036,966 | 8/1991 | Kaspar et al. | 194/217 |
| 5,125,492 | 6/1992 | Treleaven et al. . | |
| 5,184,707 | 2/1993 | Van Horn et al. | 194/217 X |

FOREIGN PATENT DOCUMENTS

| | | | |
|---|---|---|---|
| 0267985 | 9/1964 | Australia | 194/242 |
| 3542112 | 4/1987 | Germany | 194/337 |
| 1334264 | 10/1973 | United Kingdom | 194/244 |
| 1608716 | 11/1990 | U.S.S.R. | 194/244 |

*Primary Examiner*—Michael S. Huppert
*Assistant Examiner*—Scott L. Lowe
*Attorney, Agent, or Firm*—Reising, Ethington, Barnard, Perry & Milton

[57] ABSTRACT

A method and apparatus for recognizing and counting coins is disclosed. In one aspect, the apparatus is battery powered and includes a magnet which moves between two positions upon a coin moving along a coin path. Movement of the magnet activates a reed switch that wakes up a microprocessor controlled circuit from a low power quiescent state. The circuit is then operable to count the coin and to then take appropriate action. In another aspect, the apparatus includes a second magnet located near the coin path and opposite a second reed switch. This magnet keeps the contacts of the reed switch closed until a ferromagnetic object passes therebetween and shunts the magnetic field away from the reed switch. A photointerrupter is used to detect U.S. coin currency and other non-ferromagnetic objects not detected via the second reed switch. Thus, the apparatus can distinguish ferromagnetic objects from U.S. coin currency by the method of not detecting opening of the second reed switch, but detecting an object with the photointerrupter. Also disclosed is a method for identifying the particular type of coin moving along the coin path. Further, there is disclosed a battery powered apparatus used with a conventional coin separator to count coins.

7 Claims, 8 Drawing Sheets

METHOD AND APPARATUS FOR ELECTRONICALLY RECOGNIZING AND COUNTING COINS

TECHNICAL FIELD

This invention relates generally to a method and apparatus for recognizing and counting United States coin currency and, in particular, to such a method and apparatus designed to be used in coin operated machines such as vending machines. The invention also relates to a battery operated coin recognition and counting device that is particularly useful in newspaper vending machines.

BACKGROUND OF THE INVENTION

There exists today a variety of automated machines designed to provide products or services to a user while obviating the need for the owner, distributer, or other provider of those goods or services to be present at the transaction. Well known examples of such machines are food and beverage vending machines, newspaper vending machines, public telephones, video games and other amusement devices. One common characteristic of these machines is that they typically are operable only upon insertion into the machine of a predetermined, designated amount of money. Usually, these machines accept only certain coin currency such as nickels, dimes, and quarters.

Currency is deposited into a coin operated machine through one or more slots that are shaped only as large as needed to admit the intended coin currency. However, items having dimensions the same as or smaller than the intended coin currency can also be inadvertently or mischievously inserted into the slot. Therefore, to insure that the goods or services provided by the machine are only dispensed to those who have properly paid for them, coin operated machines are typically provided with a coin recognition and counting device.

Although coin recognition and counting are often accomplished using the same mechanism, they each have a different function. Coin recognition involves distinguishing valid coin currency from other objects, such as tokens, slugs, or foreign currency. For machines designed to accept more than one type of coin currency, coin recognition then further involves distinguishing between the various acceptable types of coin so that the user may be properly credited. Coin counting involves totalling the value of all the inserted coins that have been recognized as acceptable.

Coin recognition takes on many forms depending upon such factors as the value of the goods or services being provided by the machine. In its simplest form, coin recognition is accomplished by simply detecting whether an object has been inserted into the coin slot. See, for example, U.S. Pat. No. 5,125,492, issued Jun. 30, 1992 to D. H. Treleaven et al., which discloses an optointerrupter that detects an object entering the machine through a token chute.

More typically, however, coin recognition involves mechanically verifying that the dimensions and weight of the inserted object match the known dimensions and weight of the coin or coins for which the machine is designed. Moreover, United States coin currency is non-ferromagnetic and will therefore not be noticeably influenced by an impinging magnetic field. Accordingly, more sophisticated coin recognition devices utilize magnets to eliminate objects having the same dimensions and/or weight as the valid coin currency, but that contain substantial proportions of iron or other ferromagnetic materials. Elimination of ferromagnetic objects in these devices involves using the magnet to attract and separate the ferromagnetic objects, often by pulling them off one coin path and onto another which disposes of the object via a coin return or otherwise. Differentiating between valid coins has been accomplished by mechanisms that separate the coins based on their size and weight, after which they can then be counted.

It is also known to use an electromagnetic detector that is sensitive to metal coins to recognize and distinguish various types of coins. U.S. Pat. No. 4,234,071, issued Nov. 18, 1980 to S. Le-Hong, utilizes a tank circuit that is fed by an a.c. generator and a circuit that measures voltage variations in the tank circuit that result from metal objects such as coins passing by the tank circuit. This voltage variation is dependent on the characteristics of the coin passing by the detector and therefore provides a characteristic curve which can then be compared to stored curves to determine the type of coin.

Coin counting has also been accomplished in various ways. For example, the newspaper vending machines used to sell USA Today TM count coins by stacking them. Once the proper number of coins have been inserted, a bearing surface prevents upward movement of the coins by contacting the top-most portion of the edge of the uppermost coin and the bottom-most portion of the edge of the lowest coin is used as a cam surface that causes the door latch to release when the door is pulled by the user toward its open position.

More recently, coin operated vending machines have incorporated an electronic circuit that is used to count the recognized coins and to thereafter cause the good or service to be provided to the user. U.S. Pat. No. 4,216,461, issued Aug. 5, 1980 to R. L. Werth et al., discloses a vending machine having such a coin counter. Electronic circuits have also been used to monitor and store auditing information that includes the total amount collected by the vending machine. See, for example, U.S. Pat. No. 4,845,484, issued Jul. 4, 1989 to T. R. Ellsberg.

One disadvantage of some prior art coin recognition and counting devices is that the arrangements used to properly distinguish coin currency by, for example, size, weight, and magnetic characteristics, result in a complicated and somewhat bulky mechanism. It would therefore be advantageous to provide a coin recognition and counting device that minimizes the amount of mechanical manipulation required to distinguish valid coin currency from other objects.

SUMMARY OF THE INVENTION

The present invention provides a coin recognition device for a vending machine that comprises a pair of spaced guides defining a coin path therebetween, a magnet disposed proximate the coin path to provide a magnetic field extending into the coin path, a coin detector, such as a photo-interrupter, which is disposed to detect a coin moving along the coin path, and a circuit coupled to the coin detector and having a reed switch or other circuit element exposed to the magnetic field. The reed switch detects any changes in the magnetic field that occur due to a ferromagnetic object moving along the coin path. More specifically, a ferromagnetic object that moves along the path into position between the magnet and reed switch will cause the reed switch to change its conductive state and therefore inform the circuit that the object is ferromagnetic. Thus, U.S. coins, which are not appreciably ferromagnetic, have no effect on the reed switch, although they will be detected by the photo-interrupter. Accordingly, U.S. coins are recognized when a coin is detected by the photo-interrupter, but no change in the conductive state of the reed switch is detected.

In accordance with another aspect of the present invention, the circuit is operable to distinguish the type of coin moving along the coin path by determining the amount of time it takes the coin to pass a predetermined point along the coin path. This can be accomplished by using a photo-interrupter coupled to a microprocessor that is operable to periodically detect the output of the photo-interrupter. The photo-interrupter has a solid state switch which has a first conductive state whenever its beam is unobstructed and a second conductive state whenever its beam is blocked. The microprocessor is then operable to determine the type of coin passing by the photo-interrupter by determining the number of consecutive times that the second conductive state is detected by the microprocessor. For example, a quarter, having a larger diameter than a dime or nickel, will take longer to pass the photo-interrupter, thereby causing the solid state switch to exhibit the second conductive state for a longer time and thereby resulting in a higher number of consecutive times that the second conductive state is detected by the microprocessor.

Preferably, the microprocessor is operable to assign a value to each of the types of coins and to accumulate the aggregate value of coins inserted into the machine. The microprocessor is preferably operable to generate a signal in response to the aggregate value being greater than or equal to a preset value, i.e., price. For vending machines in which the price must be changed from time to time between certain preset prices, the coin recognition device can include a key switch having a plurality of positions corresponding to a plurality of preset prices and the microprocessor can then be configured to set the preset value equal to one of the prices in accordance with the position of the key switch. Preferably, the circuit is arranged such that the preset prices are adjustable by selective shorting of various nodes of the circuit.

In accordance with another aspect of the invention, there is provided an apparatus for electronically counting coins inserted into a coin operated machine. The apparatus comprises a magnet movable from a first position to a second position in response to movement of a coin along a coin path, a coin detector, such as a photo-interrupter, which is disposed to detect the coin when it moves along the coin path, and a coin counting circuit having a standby mode and a counting mode, the circuit being operable to draw less power when in the standby mode than when in the counting mode and being responsive to the coin detector when in the counting mode to count the number of coins detected by the coin detector and, further, the circuit being operable, in response to the magnet moving between the first and second positions, to change from the standby mode to the counting mode. Preferably, this apparatus is incorporated into the coin recognition device.

The circuit can include a reed switch or other magnetically responsive switch that is disposed proximate the second position such that the switch changes its conductive state when the magnet moves between the first and second positions. The circuit is then configure to change from the standby mode to the counting mode when the switch changes its conductive state. The circuit can also include a microprocessor operable under program control to selectively place the circuit in the standby and counting modes with the microprocessor being operable in a quiescent state when the circuit is in the standby mode. A change in the conductive state of the reed switch upon the magnet moving from the first position to the second position can then be used to provide an interrupt to the microprocessor that causes it to place the circuit in the counting mode.

This dual mode arrangement makes the circuit well suited for long term operation from one or more batteries. Preferably, the microprocessor disables power from the batteries to the photo-interrupters when the circuit is in the standby mode.

The magnet can be supported on a pivotally disposed carrying member having a lever arm that is pivotable into and out of the coin path such that the magnet is in the first position when the lever arm is positioned in the coin path and is in the second position when the lever arm is positioned out of the coin path. The member can then be biased to pivot the lever arm into the coin path such that the lever arm is pivotable out of the coin path by a coin moving along the coin path. If multiple coin slots and paths are provided in the coin operating machine in which the apparatus is used, the carrying member can then include a other lever arms that are pivotable into and out of other coin paths in a manner similar to the first lever arm. Gravity can be used to bias the lever arm into the coin path by arranging the carrying member such that it is disposed to pivot about an axis with its center of gravity being spaced from the axis.

In accordance with another aspect of the invention, a method is provided for detecting and counting non-ferromagnetic coins moving along a coin path. The method includes the steps of providing a magnetic field that extends into a coin path, monitoring the magnetic field to detect a change therein that results from a ferromagnetic object moving along the coin path, detecting the presence of a coin moving along the coin path, and accepting the coin as valid upon detecting the presence of the coin when no change is detected in the magnetic field. Preferably, the method includes using a reed switch or other magnetically activated switch to detect a change in the magnetic field.

In accordance with yet another aspect of the invention, a method is provided for determining whether a coin moving along a coin path is a particular type of coin, such as a quarter. The method includes the steps of (a) checking a point along the coin path to determine the presence or absence thereat of a coin, (b) repeating step (a) at time intervals that are substantially less than the time it takes the coin to pass the point, (c) generating a measured value in accordance with the number of the time intervals during which the coin is detected at the point, and (d) comparing the measured value to a predetermined range of values representative of the particular type of coin. Preferably, the method includes determining the predetermined range of values in accordance with the diameter of the particular type of coin and in accordance with the rate at which the particular type of coin moves along the coin path.

The method can be used to distinguish and recognize multiple types of coins. Preferably, this is done using including in the method the additional steps of determining a second predetermined range of values that has no values in common with the first range and that corresponds to a second particular type of coin having a diameter different than the diameter of the first particular type of coin, and comparing the measured value to the second range of values.

A preferred embodiment includes a coin recognition and counting device having a housing that is designed to be retrofitted into currently available USA Today TM newspaper rack machines that are manufactured by Casper Wireworks Inc. of Shiner, Texas. This embodiment includes two coin paths, one for dimes and one for quarters and is designed to recognize and distinguish dimes and quarters and will further recognize and distinguish between dimes and quarters deposited into the same coin path.

BRIEF DESCRIPTION OF THE DRAWINGS

The preferred exemplary embodiments of the present invention will hereinafter be described in conjunction with the appended drawings, wherein like designations denote like elements, and.

DESCRIPTION OF THE PREFERRED EMBODIMENTS

Figure 1:
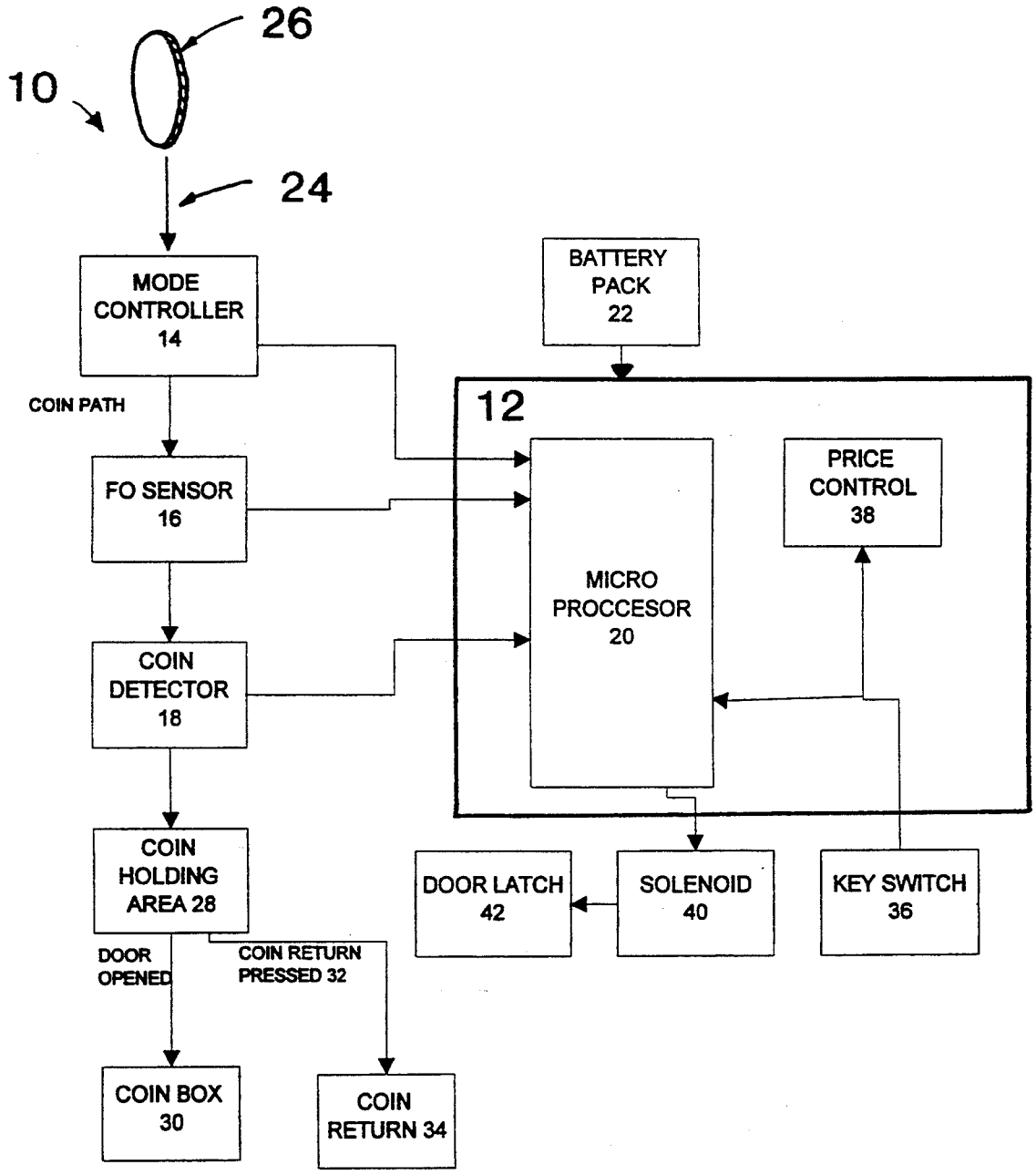
FIG. 1 is a block diagram of a coin recognition and counting device of the present invention.

FIG. 1 shows a coin recognition and counting device (CRCD) of the present invention, designated generally as 10, which is designed to be mounted within the housing of a newspaper rack vending machine (not shown). CRCD 10 includes a recognition and counting circuit 12, a mode controller 14, a ferromagnetic object (FO) sensor 16, and a coin detector 18. Mode controller 14, FO sensor 16, and coin detector 18 are electrically connected to circuit 12 to provide information to a microprocessor 20. Circuit 12, including microprocessor 20, and coin detector 18, are powered by a 9 v battery pack 22 comprising six series connected 1.5 v lithium batteries.

A coin path 24 communicates with a coin slot (not shown) formed in the housing of the vending machine and is oriented to cause objects therein to move in the direction indicated under the force of gravity. Mode controller 14, FO sensor 16, and coin detector 18 are all serially aligned along coin path 24 such that a coin 26 inserted into the coin slot moves along coin path 24 past mode controller 14, past FO sensor 16, and then past coin detector 18 and into a conventional coin holding area 28. Holding area 28 then holds the coin 26 and any other deposited coins until either the newspaper machine door is released under the control of microprocessor 20 or the machine's coin return button is pressed. If the door is released and opened, coin 26 is caused in a conventional manner to drop into a coin box 30. If the coin return button is instead pressed, coin 26 is swept into a coin return chute 32 that leads to a coin return box 34, as is described below.

CRCD 10 also includes a key switch 36 having four positions, three for selecting between three predetermined newspaper prices and the fourth for placing CRCD 10 in a service mode. The predetermined price settings are provided by a price control circuit 38 that provides microprocessor 20 with the predetermined price selected by key switch 36. CRCD 10 also includes a door latch solenoid 40 controlled by microprocessor 20 to disengage a door latch 42 whenever either CRCD 10 is placed in its service mode or the appropriate amount of currency has been deposited into the machine.

As explained in greater detail below, an object such as coin 26, upon entering coin path 24 through the machine's coin slot, is first detected by mode controller 14 which operates to wake up microprocessor 20 from a quiescent state and to thereby switch circuit 12 from a standby mode to a counting mode. Movement of coin 26 through mode controller 14 is only negligibly restricted and coin 26 therefore continues unobstructed through mode controller 14 to FO sensor 16. FO sensor 16 determines and indicates to microprocessor 20 whether or not coin 26 is ferromagnetic. FO sensor 16 tests coin 26 passively so that coin 26 moves freely past FO sensor 16. Coin 26 then moves past coin detector 18, which is also a passive detector. Coin detector 18 detects the presence or absence of coin 26 at a particular point along path 24 and is used by microprocessor 20 to determine the size of coin 26 to therefore distinguish between different, valid coins. Microprocessor 20 keeps track of the total of all the valid coins inserted and upon that total being greater than or equal to a preset price, activates solenoid 40 to open the vending machine door.

As is also explained in greater detail below, microprocessor 20, upon entering the counting mode, starts a system timer so that, if coins totalling less than the preset price are inserted and left in the machine, credit for those coins is lost after a preselected amount of time and circuit 12 then returns to its low power standby mode to avoid further power drain of battery pack 22. The coins may be recovered in the usual manner by activating the coin return button or will drop into coin box 30 along with additional coins inserted by the next user when the door is opened to remove a newspaper.

Figure 2:
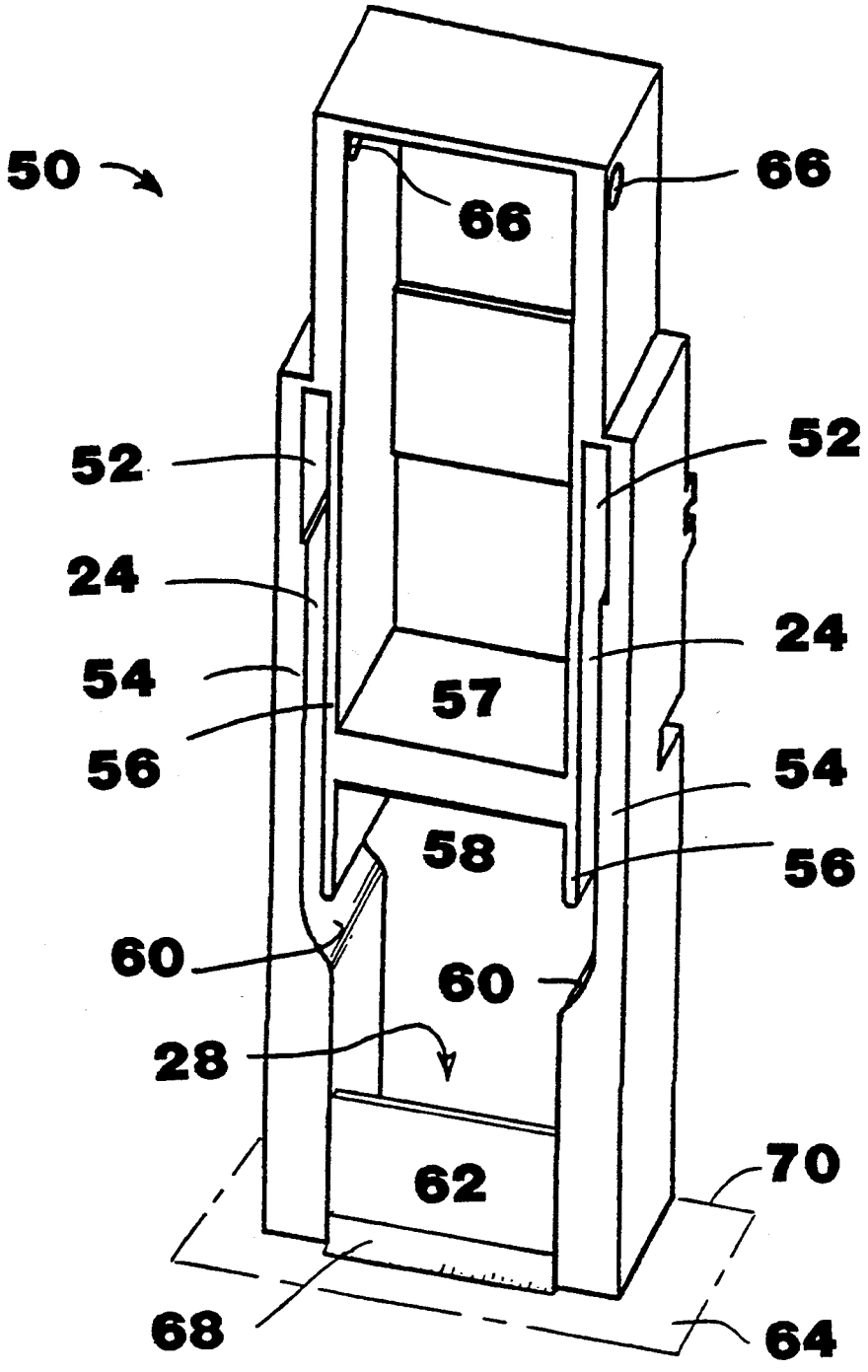
FIG. 2 is front perspective view of a housing for the coin recognition and counting device of FIG. 1.

Referring now to FIG. 2, there is shown a housing 50 designed to be retrofitted into a standard USA Today TM newspaper rack machine (not shown). Housing 50 includes coin path 24 designed to accommodate dimes, as well as a second coin path 24' designed to accommodate quarters. Coin paths 24 and 24' each have an enlarged respective opening 52, 52' at the beginning thereof that mate with corresponding slots in the housing of the newspaper rack machine. Coin path 24 is defined by guides or walls 54 and 56, and coin path 24' is similarly defined by walls 54' and 56'. A laterally extending wall 57 connects walls 56 and 56' to provide added structural integrity to housing 50. Housing 50 includes a back wall 58 on its rear side that extends along coin paths 24, 24'. The front side of paths 24, 24' are open and mate with inserts (not shown) attached to the machine's housing. As is known by those skilled in the art, the inserts extend partway into paths 24, 24' to control the height of paths 24, 24' in accordance with the type of coins (e.g., dime, quarter) that paths 24, 24' are intended to receive. The inserts and back wall 58 prevent coins from laterally exiting paths 24 and 24'. When in use, housing 50 is oriented as shown in FIG. 2 so that coins and other objects inserted therein are substantially in free fall as they move along coin paths 24, 24'.

Wall 54 has a curved portion 60 that acts to direct coin 26 inwardly of the housing 50 and toward the center of coin holding area 28 as it falls through coin path 24. Wall 54' is similarly constructed, except that the downward extent of wall 56' is less than that of wall 56 to account for the larger size of the quarters that pass along coin path 24'. Preferably, walls 54 and 56, including portion 60, are configured to permit any object that can be inserted into the vending machine coin slot to fall through coin path 24 and into holding area 28. This helps reduce the opportunity for objects to become stuck in coin path 24 which could otherwise render CRCD 10 inoperative. Walls 54' and 56' are similarly configured.

Coin holding area 28 is defined by walls 54, 54', 58, a front wall 62, and a floor member 64, which is not part of housing 50. Coin 26 therefore rests on floor member 64 after passing through either coin slot 24 or 24'. As is known by those skilled in the art, floor member 64 is coupled to the door of the vending machine such that, when opened, it causes floor member 64 to move out from underneath the coins held in holding area 28 and the coins therefore drop into coin box 30, which is located below housing 50. Housing 50 also includes a pair of apertures 66 through which a rod (not shown) can extend to permit pivoting of housing 50 about the axis defined by apertures 66. As is known, housing 50 is coupled to a coin return button (not shown) mounted on the vending machine housing such that, when pressed, it causes housing 50 to pivot backwards about that axis. When housing 50 pivots in this manner a resilient coin sweeper 68, which is located along the lower edge of front wall 62, acts to sweep the coins in holding area 28 off a back edge 70 of floor member 64. The coins then fall through coin return chute 32 and into coin return box 34, as shown diagrammatically in FIG. 1.

Figure 3:
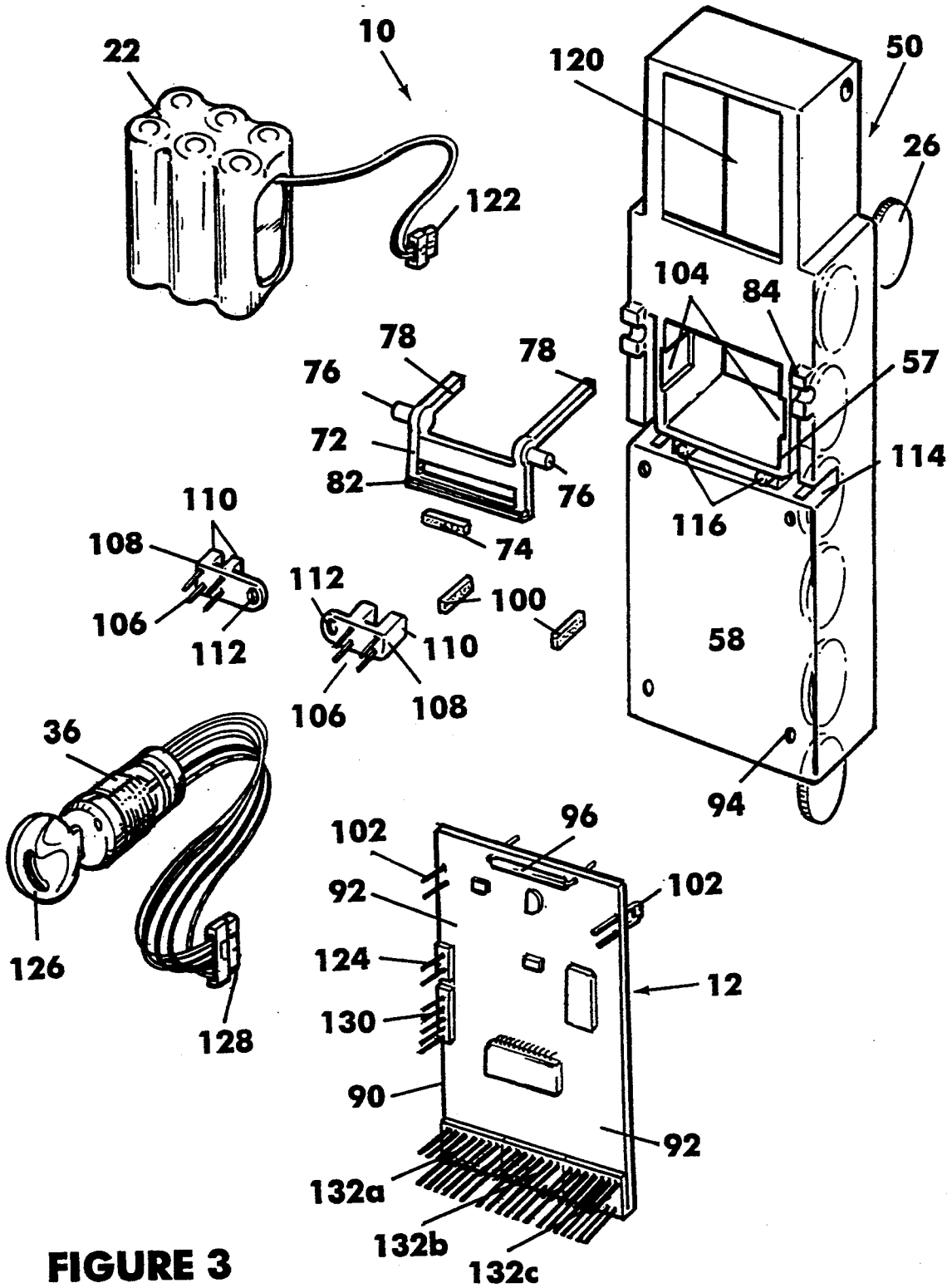
FIG. 3 is a partially exploded perspective rear view of the coin recognition and counting device of FIG. 1, including the housing shown in FIG. 2.

FIG. 3 depicts the backside of housing 50, as well as the other components of CRCD 10. Mode controller 14 comprises a carrying member or flapper 72 and a permanent magnet 74. Flapper 72 includes a pair of trunnion arms 76, 76', a pair of lever arms 78, 78', and a frame 80 that includes a cross support 82 to which magnet 74 is adhered or otherwise secured. Trunnion arms 76, 76' snap into corresponding mounts 84, 84' on housing 50 to thereby permit flapper 72 to pivot about trunnion arms 76, 76'. Lever arms 78, 78' extend into coin paths 24, 24' and flapper 72 is normally biased such that lever arms 78, 78' extend into coin paths 24, 24' perpendicular to the direction of coin travel through those paths. This bias is due to the weight of frame 80, cross support 82, and magnet 74; that is, the center of gravity of flapper 72 is spaced from the trunnion axis such that magnet 74 normally hangs adjacent housing 50 and lever arms 78, 78' normally extend perpendicularly into their respective coin paths 24, 24'. It will of course be understood that other means, such as a spring, for biasing flapper 72 into its normal position can be used. Flapper 72 remains in its normal position until a coin is inserted into either of the coin paths 24, 24'. As will be appreciated, when coin 26 moves through either coin path 24 or 24', it contacts one of the lever arms 78, 78', causing flapper 72 to rotate about the trunnion axis and thereby resulting in magnet 74 being moved from its normal position to an extended position. As discussed below, this movement is sensed by circuit 12 and is used to change circuit 12 from a low power standby mode to a counting mode in which it is operable to recognize, distinguish, and count coin 26.

Circuit 12 is implemented on a printed circuit board (PCB) 90 which is mounted to back wall 58 of housing 50. PCB 90 is mounted using screws that extend through each of four apertures 92 therein and corresponding apertures 94 in back wall 58. The position of PCB 90 on back wall 58 is selected such that a reed switch 96 mounted on PCB 90 and forming a part of circuit 12, is located proximate the extended position to which magnet 74 moves when coin 26 is inserted into either coin path 24 or 24'. More specifically, the position of PCB 90 and the position of reed switch 96 on PCB 90 are coordinated with respect to magnet 74 such that when magnet 74 is in its normal position adjacent housing 50, magnet 74 is spaced far enough away from reed switch 96 that its magnetic field does not affect reed switch 96 and reed switch 96 is therefore in its normally open (non-conducting) position. These positions are also coordinated such that when magnet 74 is moved to its extended position under the force of coin 26 moving through one of the coin paths, the magnetic field produced by magnet 74 causes reed switch 96 to change to its closed (conducting) position. Standoffs or other means can be used to accurately position reed switch 96 on PCB 90 to achieve the appropriate spacial relationship between reed switch 96 and magnet 74. It will thus be appreciated that reed switch 96 can be used by circuit 12 to detect movement of a coin in either coin path 24 or 24'.

FO sensor 16 comprises permanent magnets 100, 100' and reed switches 102, 102'. Magnet 100 is adhered or otherwise mounted within a recess 104 formed in a side of wall 56 opposite coin path 24. Magnet 100' is similarly mounted within a recess 104' in wall 56'. Reed switches 102, 102' are positioned on PCB 90 such that when PCB 90 is mounted to housing 50, reed switches 102, 102' are located on either side of housing 50 adjacent their respective walls 54, 54' and directly across from their corresponding magnets 100, 100'. Thus, reed switch 102 is separated from magnet 100 by the thickness of wall 54, the width of coin path 24, and the thickness of wall 56 at recess 104. Reed switch 102' and magnet 100' are similarly spaced.

Magnet 100 is selected to produce a magnetic field strong enough to maintain reed switch 102 closed when no ferromagnetic object is present in coin path 24 between magnet 100 and reed switch 102 and yet is weak enough that a ferromagnetic object passing between magnet 100 and reed switch 102 acts to momentarily shunt the magnetic field such that reed switch 102 momentarily opens its contacts. As discussed above, U.S. coin currency is not appreciably ferromagnetic and, therefore, will not interrupt the magnetic field to the extent necessary to cause a change in the conductive state of reed switch 102. However, many other metal objects are ferromagnetic and will cause reed switch 102 to momentarily open its contacts. As discussed in greater detail below, a change or lack thereof in reed switch 102 is used by circuit 12 to distinguish between U.S. coins and other ferromagnetic objects, such as foreign coin currency. Of course, the foregoing discussion applies equally to magnet 100' and reed switch 102'.

Coin detector 18 comprises a pair of photointerrupters 106 and 106' located along coin paths 24 and 24', respectively. Photointerrupter 106 has a housing 108 that includes two spaced projections 110 and an aperture 112. Projections 110 are preferably spaced by an amount greater than or equal to the width of coin path 24. As indicated in FIG. 3, each of these projections 110 fit into a corresponding slot 114 in walls 54 and 56 with aperture 112 receiving a post 116 formed in the backside of wall 57. Although not shown, photointerrupter 106 is mounted on PCB 90 such that it fits into slot 114 when PCB 90 is mounted to housing 50. Photointerrupter 106' can be identical to photointerrupter 106. Accordingly, walls 54' and 56' are slotted in the same manner as walls 54 and 56 to receive photointerrupter 106' and the backside of wall 57 also includes a post 116' to receive aperture 112'.

Projections 110 each have a small opening facing the opening in the other projection. One of the projections 110 transmits light out through its opening and the other projection receives light in through its opening. As is known to those skilled in the art, in the absence of an opaque object between projections 110, light transmitted from one of the projections 110 is detected by the receiver in the other projection and causes a solid state switch, such as a transistor collector and emitter, to switch from a non-conducting state to a conductive state. In its application to CRCD 10, when coin 26 moves along coin path 24 and passes between the two projections 110, the transmission of light between projections 110 is momentarily blocked, and the solid state switch in photointerrupter 106 switches from a conductive state to a non-conductive state. As described in greater detail below, this change in state and the duration of that change is detected by circuit 12 to indicate the presence of coin 26 in coin path 24 and to determine which of several particular types of coins (e.g., nickel, dime, or quarter) coin 26 is. The operation of photointerrupter 106' in connection with coin path 24' is identical.

Battery pack 22 can be mounted within the upper portion 120 of housing 50 to minimize the overall size of CRCD 10. Battery pack 22 supplies power to circuit 12 via a socket connector 122 that mates with a plug 124 on PCB 90. PCB 90 also includes a plug connector (not shown) for connecting solenoid 40 to circuit 12.

Key switch 36 is mounted on the frame of the newspaper vending machine so that a key 126 can be inserted into key switch 36 from outside the machine. Key switch 36 is wired to circuit 12 via a socket connector 128 and a corresponding plug 130 on PCB 90.

Price control circuit 38 includes three sets of dual row straight pin headers 132*a–c*. The pin headers 132*a–c* each correspond to a different newspaper price, which is selected by the position of key switch 36 in accordance with whether the newspaper being dispensed is a daily, Sunday, or special edition. The newspaper price used by circuit 12 is chosen by the position of key switch 36, as described below. One or more jumpers (not shown) are positioned on each pin header 132 in accordance with the desired price for the particular edition to which that pin header corresponds.

Figure 4:
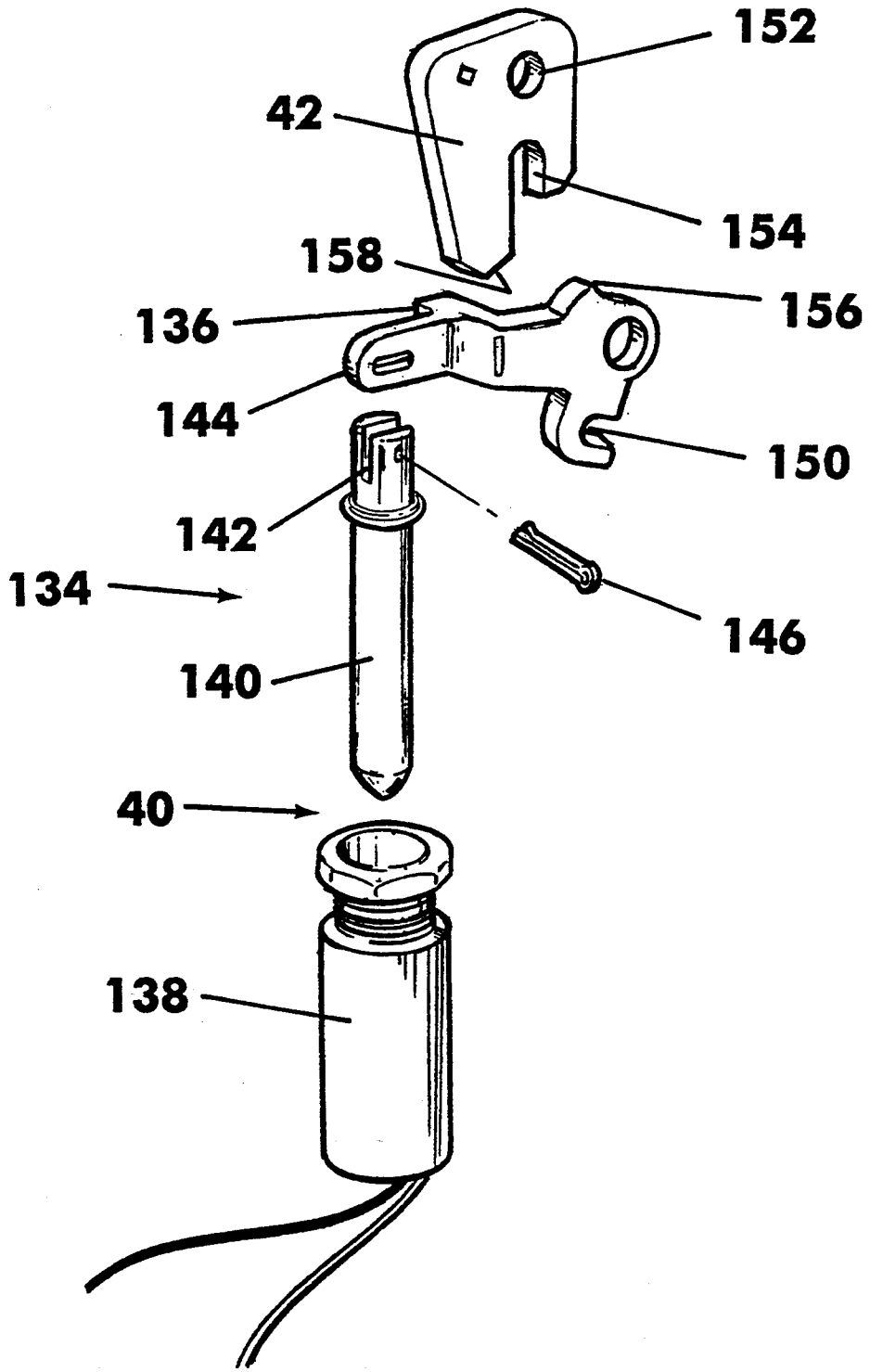
FIG. 4 is an exploded view of a solenoid latch mechanism used with the coin recognition and counting device shown in FIG. 3.

Referring now to FIG. 4, a solenoid latch release mechanism 134 is shown which is operable by circuit 12 to unlatch the vending machine door. Release mechanism 134 includes solenoid 40, a detent lever 136, and door latch 42. Solenoid 40 includes a housing 138 and a plunger 140 which is pulled into housing 138 upon energization of a coil (not shown) within housing 138. A slot 142 in the exposed end of plunger 140 receives an extension 144 of detent lever 136. Extension 144 is held in place by a cotter pin 146. Detent lever 136 has a hole 148 therein that receives a shaft (not shown) so that lever 136 can pivot about hole 148. Detent lever 136 also includes a notch 150 to which a spring (not shown) is attached to bias extension 144 and plunger 140 upward in a door latched position. Door latch 42 comprises a fork bolt having a hole 152 which receives a shaft (not shown) about which it pivots. Door latch 42 also includes a catch 154 which contacts the vending machine door striker (not shown) that is mounted on the machine door.

When solenoid 40 is energized by circuit 12, plunger 140 is pulled into housing 138, thereby moving extension 144 downward to a door release position. Consequently, a bearing surface 156 on detent lever 136 moves downward and away from a corresponding surface 158 on door latch 42, thereby freeing door latch 42 for rotation about hole 152 in a counterclockwise direction upon the vending machine door being pulled open. When solenoid 40 is not energized, extension 144 is biased upwards by the spring acting on notch 150, causing bearing surface 156 to engage surface 158 to thereby prevent door latch 42 from rotating counterclockwise. Accordingly, the door striker engages catch 154 and the machine door is prevented from being opened.

Figure 5:
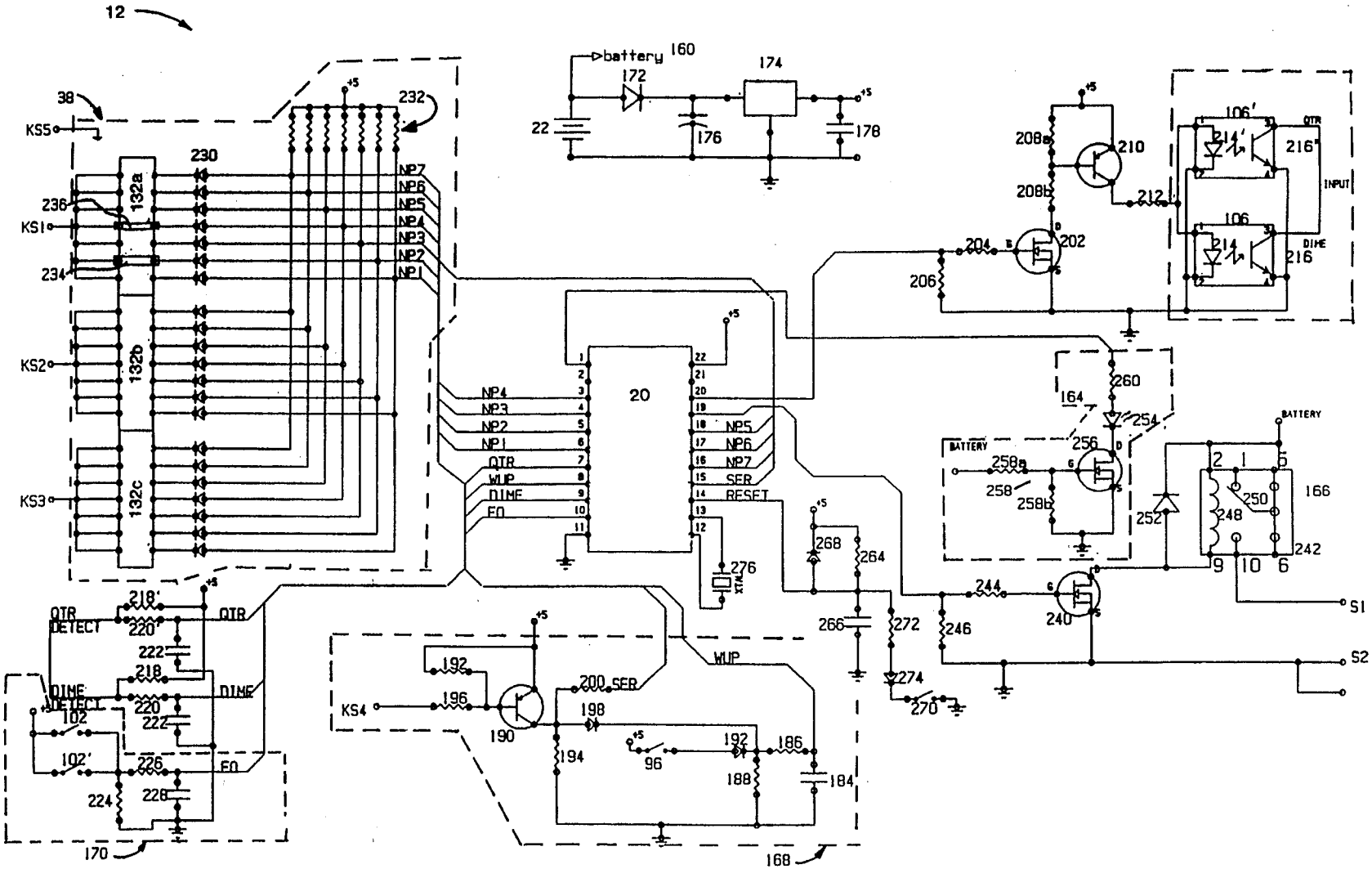
FIG. 5 is a schematic of the recognition and counting circuit shown in FIG. 3.

Turning now to FIG. 5, the details of circuit 12 are shown. The part numbers and values of the various components of circuit 12 are given in the attached Appendix. Circuit 12 includes price control circuit 38, a power supply 160, microprocessor 20, a photointerrupter driver 162 for coin detector 18, a low battery detection circuit 164, a solenoid energizing circuit 166, a coin intrusion and service interrupt circuit 168, and a ferromagnetic object recognition circuit 170. Power supply 160 includes battery pack 22 that provides a battery voltage rail (labelled BATTERY). Battery pack 22 is connected through a diode 172 to a fixed, 5 v voltage regulator 174, such as a TK11650 manufactured by NEC. Regulator 174 is a three-terminal regulator connected within power supply 160 in a conventional manner to receive the unregulated voltage from battery pack 22 and to supply a regulated five volts, which is labelled as +5. Filter capacitors 176 and 178 are provided on the input and output, respectively, of regulator 174.

Microprocessor 20 is programmed to operate in three modes: standby, counting, and service. In its standby mode, microprocessor 20 operates in a low-current quiescent state to minimize the drain of power from battery pack 22. In this mode, it also disables operation of photointerrupters 106, 106' via drive amplifier 162, as described below. In its counting mode, microprocessor 20 executes a coin recognition and counting procedure and turns on photointerrupters 106, 106'. In this mode, microprocessor 20 is operable to detect and count coins moving along coin paths 24 and 24'. In the service mode, microprocessor 20 operates solenoid 40 via switching circuit 166 to unlatch the door and permit loading of the newspaper vending machine with the latest newspaper edition. In this mode, it also enables low battery detection circuit 164 to provide a warning in the event battery pack 22 needs replacement.

Interrupt circuit 168 is used to change microprocessor 20, and therefore circuit 12, from a standby mode to either the counting or service modes. Interrupt circuit 168 includes reed switch 96 (which is used with mode controller 14) and an input filter 180 that provides a time constant to, in effect, debounce reed switch 96. One end of reed switch 96 is connected to the regulated five volts (+5). The other end is connected to input filter 180 via a diode 182. Input filter 180 includes a capacitor 184 connected between an interrupt pin of microprocessor 20 and ground. Upon closing of reed switch 96, capacitor 184 is charged through diode 182 and a resistor 186 which is selected in value to provide the desired charging rate of capacitor 184. As will be appreciated, once capacitor 184 charges to the voltage recognized by microprocessor 20 as a logical one, the voltage on capacitor 184 operates as an interrupt to microprocessor 20. A second resistor 188 connected between ground and the cathode of diode 182 operates to discharge capacitor 184 at a desired rate once reed switch 96 reopens.

Interrupt circuit 168 also couples key switch 36 to input filter 180 to thereby generate an interrupt when key switch 36 is moved to its service position. In particular, key switch 36 has an input terminal labelled KS4, which it connects to ground via a common key switch terminal when key switch 36 is in its service position. When key switch 36 is not in its service position, terminal KS4 is open circuited. When open circuited, a pnp transistor 190 is biased off via a resistor 192 so that its collector is biased to ground via a resistor 194. When node KS4 is grounded via key switch 36, current is drawn through resistor 196 and the voltage at the base of transistor 190 is reduced to a voltage sufficient to turn on transistor 190, thereby providing a logical one at its collector. Since the collector of transistor 190 is coupled to input filter 180 via a diode 198 in the same manner as reed switch 96, capacitor 184 is then charged and an interrupt is generated. Diode 198 prevents the closure of reed switch 96 from providing a logical one at the collector of transistor 190. The collector of transistor 190 is also coupled to microprocessor 20 via a resistor 200 so that, when microprocessor 20 receives the interrupt from filter 180, it can determine whether that interrupt was generated by insertion of an object into CRCD 10 that caused reed switch 96 to change its conductive state or by key switch 36 being moved to its service position.

Upon microprocessor 20 entering its counting mode, it enables power to photointerrupters 106, 106' via photointerrupter driver 162. Driver 162 includes an N-channel MOSFET 202 coupled to an output of microprocessor 20 via an input protection resistor 204. A pulldown resistor 206 insures that MOSFET 202 will not be switched on by leakage current coming from the output of microprocessor 20. The source of MOSFET 202 is connected to ground and its drain is connected to the bottom of a voltage divider 208 which is connected at its top to +5. The node between resistors 208a and 208b of voltage divider 208 is connected to the base of a pnp transistor 210. As will be appreciated, when MOSFET 202 receives a logical zero from microprocessor 20, it remains switched off, resulting in transistor 210 being biased off by the upper resistor of voltage divider 208. Accordingly, no power is supplied to photointerrupters 106, 106'. When the input of MOSFET 202 receives a logical one, it turns on thereby pulling the voltage at the base of transistor 210 down to a voltage sufficient to switch transistor 210 on. When transistor 210 turns on, current is provided via a current limiting resistor 212 to an LED 214, 214' in each of the respective photointerrupters 106, 106'.

In accordance with the conventional operation of photointerrupters, current through LEDs 214, 214' cause light to be emitted therefrom which switches on their associated transistors 216, 216' in the absence of an opaque object therebetween. The output of transistors 216, 216' is taken at their collectors, which are biased to +5 via pullup resistors 218, 218', respectively. The collector of transistor 216 is coupled to an input (labelled DIME) to microprocessor 20 by an input filter comprising a resistor 220 and a capacitor 222. This input filter operates in a manner similar to input filter 180 of interrupt circuit 168. The time constant of this filter can be selected to be slow enough to protect the DIME input from spurious signals such as may occur, for example, by small metal pieces or other objects that may undesirably switch off transistor 216 of photointerrupter 106. Similarly the collector of transistor 216' is coupled to a different input (labelled QTR) of microprocessor 20 by a similar input filter having a resistor 220' and a capacitor 222'. Thus, when circuit 12 is in its counting mode (i.e., power is enabled to photointerrupters 106, 106' by microprocessor 20) and there is no object in between either LED 214 and transistor 216 or LED 214' and transistor 216', then transistors 216 and 216' are both switched on, resulting in a logical zero at the DIME and QTR inputs to microprocessor 20. If an object comes between LED 214 and transistor 216, then transistor 216 turns off and the DIME input is again pulled high by resistor 218. Similarly, if an object comes between LED 214' and transistor 216', then transistor 216' turns off and the QTR input is again pulled high by resistor 218'. As described below, if no ferromagnetic object is detected, microprocessor 20 is operable to periodically sample the QTR and DIME inputs to determine how long it takes the coin to move past the associated photointerrupter and, therefore, what type of a coin has been inserted into the machine.

Ferromagnetic object recognition circuit 170 uses reed switches 102, 102' discussed in connection with FIG. 3 to detect the presence, or lack thereof, of a ferromagnetic object moving along coin paths 24 and 24'. Reed switches 102, 102' are connected in parallel, each having one end connected to +5 and the other end coupled to ground via a pulldown resistor 224. This other end of each reed switch 102, 102' is coupled to an input (labelled FO) to microprocessor 20 via an input filter comprising a resistor 226 and a capacitor 228. This input filter operates in a manner similar to input filter 180 of interrupt circuit 168 to effectively debounce reed switches 102, 102'. Thus, when no ferromagnetic object is detected in either coin path by FO sensor 16, pulldown resistor 224 provides a logical zero to the FO input of microprocessor 20. Conversely, a ferromagnetic object in either of the coin paths 24, 24' will cause one of the reed switches 102, 102' to close, resulting in a logical one on the FO input.

Price control circuit 38 comprises three pin headers **132*a–c*, as discussed above. For each of these pin headers, one row of pins is connected to a different terminal of key switch 36 (labelled KS1, KS2, and KS3) and each of the pins of the opposing row are connected via a diode 230 to the corresponding pin from the other pin headers and to one of the data inputs (labelled NP1–NP7) of microprocessor 20. Thus, pin headers 132***a–c* are each coupled with the same data inputs of microprocessor 20. The convention for these data inputs is active low and, therefore, each of these inputs is coupled to +5 by one of a plurality of pullup resistors 232. As will be understood by those skilled in the art, any one of the data inputs NP1–NP7 will be low only when one of the pins to which it is connected is connected to its opposing pin by a jumper and that opposing pin is connected to ground via key switch 36. For example, as shown in FIG. 5, if the position of key switch 36 is such that terminal KS1 is connected to ground via the common terminal (labelled KS5) of key switch 36, then data inputs NP2 and NP4 would be held low due to the placement of jumpers 234 and 236. These data inputs are read as a binary number, which is then multiplied by a base amount which is stored in memory. For example, for a base amount of five cents, the position of jumpers 234, 236 result in a binary 1010 (a decimal 10) and the price set by header 132*a* is therefore fifty cents. This price might correspond to, for example, the daily price (weekdays and Saturdays) for a newspaper. Pin header 132*b* might then correspond to the price for the Sunday edition and would include jumpers positioned in accordance with the desired Sunday price. This Sunday price would then become active upon key switch 36 being positioned such that terminal KS2 is connected to ground via terminal KS5.

Solenoid energizing circuit 166 operates solenoid 40 to permit access to the interior of the newspaper vending machine, as described above in connection with FIG. 4. It includes an N-channel MOSFET 240 that operates a relay 242 to provide power from battery pack 22 directly to solenoid 40. MOSFET 240 is activated by microprocessor 20 in much the same manner as MOSFET 202 of photointerrupter drive circuit 162. Its gate is coupled via an input protection resistor 244 with an output of microprocessor 20. The microprocessor output is coupled to ground through a pulldown resistor 246 to protect MOSFET 240 from inadvertently switching on due to leakage out of the microprocessor output. The drain of MOSFET 240 is connected to a coil 248 of relay 242 and its source is connected to ground. The other end of relay 248 is connected to the battery voltage rail. Relay 242 also includes a switch 250 operated by coil 248. The common terminal of switch 250 is connected to the battery voltage rail and the normally open terminal is connected to one end of the coil of solenoid 40 via a terminal S1. The other end of the solenoid coil is connected to ground via a terminal S2. Thus, a logical one from the associated output of microprocessor 20 switches MOSFET 240 on, energizing coil 248 and closing the contacts of switch 250 to thereby connect the coil of solenoid 40 to the battery voltage rail. Transients generated by coil 248 when MOSFET 240 is switched off are clamped to the battery voltage rail by a diode 252.

Referring again briefly to FIG. 4, solenoid 40 is energized for 100 msec. During that time, door latch 42 rotates counterclockwise about hole 152 under the force of gravity and, as a result, surface 158 passes by bearing surface 156. Once solenoid 40 is de-energized, detent lever 136 rotates back to its door latched position, but does not engage surface 158 with bearing surface 156 due to the previous rotation of door latch 42. Thus, the door may be opened even after de-energization of solenoid 40. Alternatively, door latch 42 can be spring biased to rotate counterclockwise to "kick out" the door upon solenoid 40 being activated and bearing surface 156 thereby being moved downwardly away from surface 158 on door latch 42. In either arrangement, solenoid 40 is only momentarily activated to minimize the amount of battery power consumed.

With continued reference to FIG. 5, low battery detection circuit 164 is used to indicate to service personnel when battery pack 22 has become drained to the point at which it needs to be replaced. Accordingly, it is only enabled when key switch 36 is moved to its service position. Detection circuit 164 includes an LED 254 which is connected to and activated via a P-channel MOSFET 256 when the battery voltage rail drops below a predetermined value. A voltage divider 258 connected between the battery voltage rail and ground is used to select the voltage at which LED 254 is to be activated. In particular, the gate of MOSFET 256 is connected to the common point of the two resistors 258*a* and 258*b* of voltage divider 258. As will be understood by those skilled in the art, the values of the two resistors are chosen in accordance with the predetermined value of the battery voltage rail at which activation of LED 254 is desired and in accordance with the threshold voltage of MOSFET 256 (i.e., the voltage drop between the source and gate of MOSFET 256 needed to switch it on). The cathode of LED 254 is connected to the source of MOSFET 254 and its anode is coupled to an output of microprocessor 20 via a current limiting resistor 260. Microprocessor 20 is programmed to put a logical one on this output only upon it being put into service mode via key switch 36. Thus, even if the battery voltage rail falls below the predetermined value, detection circuit 164 will not become operational and increase the drain on battery pack 22 until there is a serviceman present who can detect this low battery voltage condition and take corrective action.

Circuit 12 also includes a reset circuit 262 connected to a reset input of microprocessor 20. Reset circuit 262 includes a resistor 264 connected between +5 and the reset input. Resistor 264 is used to charge a capacitor 266 upon battery pack 22 being connected in circuit. This permits the +5 rail to come up to its full voltage before microprocessor 20 begins execution of its program. A diode 268 clamps the reset input to the +5 rail so that transient drops in the +5 rail due to, for instance, activation of solenoid 40, will not result in the voltage on the reset input being substantially greater than the supply voltage of microprocessor 20. Reset circuit 262 also includes lever switch 270 that is located on PCB 90 such that it closes upon the machine coin return button being pressed. In particular, lever switch 270 is located on PCB 90 such that, when the coin return button is pressed to thereby rotate housing 50 in the manner discussed above in connection with FIG. 2, lever switch 270 contacts the side of coin return chute 32 (or some other surface in the newspaper vending machine) and closes its normally open contacts. As a result, capacitor 266 discharges through a resistor 272 and a diode 274. The resistance of resistor 272 is chosen relative to that of resistor 264 such that the reset input connected to the common node of those two resistors receives a logical zero upon switch 270 closing and capacitor 266 discharging to its steady state value. Thus, microprocessor 20 will be reset each time the coin return button is pressed.

Lastly, microprocessor 20 is connected to a conventional oscillator 276 which provides an eight MHz clock to microprocessor 20.

Figure 6:
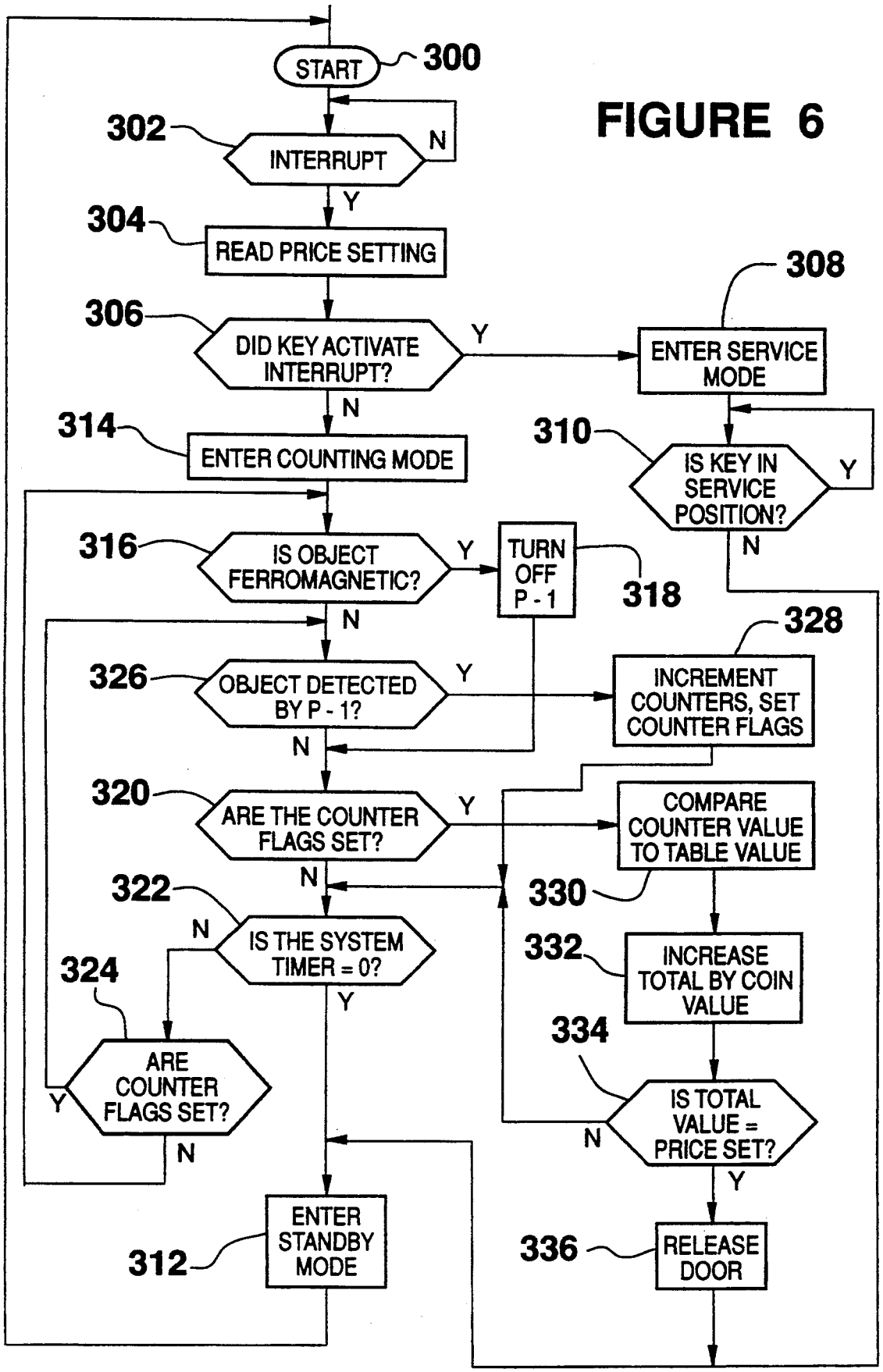
FIG. 6 is a flow chart showing the operation of the counting and coin recognition device of FIG. 1.

Referring now to FIG. 6, the operation of CRCD 10, as controlled by a program executed by microprocessor 20, will now be described. The process flow begins at start block 300 wherein circuit 12 is in its standby mode with microprocessor 20 operating in a low-power quiescent state and power to photointerrupters 106, 106' being disabled. Circuit 12 remains in this mode as long as no interrupt is received by microprocessor 20, as indicated at block 302. Upon an interrupt being received, flow moves to block 304 where the price setting is read from price control circuit 38 and into microprocessor 20 memory. Then, at block 306, it is determined whether the interrupt was generated by key switch 36 being moved to the service position or by mode controller 14 detecting an object moving through either coin path. As discussed above in connection with FIG. 5, this determination is done by checking the microprocessor 20 data input labelled SER that is provided by interrupt circuit 168.

If the interrupt was generated via key switch 36, then flow moves to block 308 where circuit 12 enters its service mode. As a part of entering the service mode, circuit 12 is operable under control of microprocessor 20 to enable low battery detection circuit 164 and to pulse solenoid 40 to release the door. Circuit 12 then waits until the newspaper vending machine is loaded with a new edition, the price settings are changed, and/or battery pack 22 is replaced. This is accomplished at block 310 where microprocessor 20 monitors the position of key switch 36 to determine when it is moved out of its service position. Flow then moves to block 312 where microprocessor 20 returns circuit 12 to its standby mode and flow then returns to start block 300.

If, at block 306, the interrupt is determined to have been generated by an object being inserted into one or both of the coin paths, rather than by key switch 36, then circuit 12 enters the counting mode, as indicated at block 314. Although circuit 12 simultaneously and independently monitors coin paths 24 and 24', it will be assumed in the following description that the object has been inserted into coin path 24. Upon entering the counting mode, microprocessor 20 enables power to photointerrupters 106, 106', begins a system timer countdown, and disables the external interrupt. As will be appreciated by those skilled in the art, the external interrupt is disabled at this point so that further interrupts generated by mode controller 14 will be ignored and will not restart execution of the interrupt routine. Flow then moves to block 316 where microprocessor 20 monitors the output of FO sensor 16 to determine whether the object that caused the interrupt to be generated is ferromagnetic or not.

Since the flow through the flow diagram of FIG. 6 is dependent upon whether the object is ferromagnetic or not, the flow will hereafter be described starting at block 316 for both a ferromagnetic object, such as an ordinary steel washer, and for a non-ferromagnetic object, such as U.S. coin, with the former situation being described first. Assuming, then, that the object is ferromagnetic and therefore is detected by FO sensor 16, photointerrupters 106, 106' are turned off long enough for the object to move past photointerrupter 106, as indicated at block 318. Flow is then transferred to block 320 which checks the condition of two counter flags. Both of these flags are internal to microprocessor 20 and each is associated with a different one of the coin paths 24, 24'. Since the counter flags are not set (the flags having initially been reset), flow moves to block 322 which checks to determine whether the system timer has timed out (i.e., reached zero). If it has, circuit 12 is returned to the standby mode at block 312 and flow returns to start block 300. If the system timer has not yet timed out, flow is transferred to block 324 which again checks the status of the counter flags. Since that flags have not been set, flow moves back to block 316 to again check for ferromagnetic objects. If the ferromagnetic object has not yet passed by FO sensor 16 and is still being detected thereby, then the process will again loop through blocks 318, 320, 322, and 324 and back to 316. Once the object passes by FO sensor 16, the process flow will then move from block 316 to block 326. However, photointerrupters 106, 106' which were turned off at block 318, remain off long enough for the object to pass by. Therefore, the flow transfers to block 320 and then block 322 and will continue to loop through blocks 324, 316, 326, 320, and back to 322 until the system timer is equal to zero, at which time flow moves from block 322 to block 312, where circuit 12 again enters the standby mode. As a part of entering the standby mode, microprocessor 20 enables the external interrupt so that mode controller 14 or key switch 36 can again be used to wake it up out of the standby mode. The flow then returns to start block 300.

Assuming now that the object is not detected by FO sensor 16 at block 316 (i.e., the object is not appreciably ferromagnetic), then photointerrupters 106, 106' remain operational and flow moves to block 326. If the object has not yet moved into position between the transmitter and receiver of photointerrupter 106, then the process flow will loop through blocks 320, 322, 324, 316, and back to block 326. The flow will continue to loop in this manner until the object is detected by photointerrupter 106, at which point flow will be transferred to block 328. At this point a counter internal to microprocessor 20 and associated with coin path 24 will be incremented (the counter having previously been reset to zero). Additionally, the counter flag associated with coin path 24 is set to indicate that its associated counter is non-zero. Flow then moves to block 322 which makes certain that the timer has not yet timed out. If not, flow moves to block 324 and from there back to block 326, since the counter flag has now been set. The process flow will then continue to loop through blocks 328, 322, 324, and 326, each time incrementing the appropriate internal counter by one, until the object has moved past photointerrupter 106. Thus, the final number stored in the counter represents the length of time between when the leading edge of the object passes photointerrupter 106 and when the trailing edge of the object passes photointerrupter 106.

Photointerrupter 106 is sampled by microprocessor 20 at a rate that depends upon the clock rate and the number (and length) of instructions that are required to cycle through this loop. For example, for a 2 μsec cycle and 5 one cycle instructions, the sample rate would be every 10 μsec. Since it takes on the order of three magnitudes longer than this sample rate for a coin in free fall to pass by photointerrupter 106, the counter being incremented at the 10 μsec rate is used to increment a second counter once for every one hundred counts of the first counter. This second counter would then have an effective sampling rate of 1 μmsec.

Moreover, it will be appreciated that, once the object passes completely by photointerrupter 106 so that the looping through blocks 328, 322, 324, and 326 then ends, the resulting number stored in the second counter will be a function of the size of the object and the rate at which it moved past photointerrupter 106. Thus, assuming that rate is known or is within a range of possible rates, the number stored in the second counter can be used to determine whether the object is a particular type of coin (e.g., a nickel). Accordingly, the number can be used to determine which of several types of coins (e.g., nickel, dime, quarter) the object is. Once this is determined, the user can then be properly credited for the coin, as discussed below.

After the object passes by photointerrupter 106, flow is transferred from block 326 to block 320. Since the counter flag associated with coin path 24 has been set, flow moves to block 330 where the number stored in the second counter is compared to predetermined ranges of values that are stored in a look-up table and that correspond to particular types of coins; namely, nickels, dimes, and quarters. Each range of values is predetermined in accordance with the diameter d of the type of coin to which that range relates and, in particular, is determined as follows. First, an estimate of the actual time T it would take the coin to pass a point when in free fall is determined according to the following formula:

$$T = \sqrt{\frac{2d}{9.8 \times 10^{-3} \frac{\text{mm}}{\text{msec}^2}}}$$

where the diameter d is measured in millimeters and the calculated time T is in milliseconds. Then, the limits of the range are set equal to ±5% of this resultant time. Thus, for quarters, which have a diameter of approximately 24 mm, the time T would equal 70 msec and the range would therefore be 66 to 74, after rounding away from the computed time T. After computing all the ranges, they are adjusted as needed to insure that they do not overlap. Of course, rather than adjusting the ranges after they have been determined, overlap can be avoiding by selecting a tolerance, such as ±3%, that is smaller than ±5%. Once determined, the ranges are stored in a non-volatile memory within microprocessor 20. Thus, in order to determine whether the object is a quarter, the second counter (whose number is also in msec) would be compared to this range and, if within the range, microprocessor 20 will assume the object is a valid quarter. If it is not within the range, then the number stored in the second counter would be compared against a second range corresponding to dimes and, if not within that range, then to a third range corresponding to nickels.

After the number stored in the second counter is compared to the various ranges at block 330, flow continues to block 332. If the number stored in the second counter was determined at block 330 to be within one of the predetermined ranges, then the user is appropriately credited by increasing a stored total (initially set to zero), by the coin value (e.g., five, ten, or twenty-five) that corresponds to the range within which the number fell. Since the object has now been fully detected (having now completely passed photointerrupter 106), the counters and counter flag are cleared in anticipation of another object being inserted into coin path 24. Flow then moves to block 334 where the total is compared to the price read in earlier at block 304. If the total is less than the price, then flow moves to block 322 where the system timer is again checked and, if it has not timed out, flow moves to block 324 and the process flow will again loop through blocks 316, 326, 320, 322, and 324, waiting either for another object or for the system timer to run out. If, at block 334, the total is greater than or equal to the price, then flow instead moves to block 336 where the solenoid is pulsed to release the vending machine door, after which circuit 12 re-enters its standby mode at block 312 and flow returns to start block 300.

Although circuit 12 is preferably configured as described above to distinguish coins based upon the time it takes the coin to pass photointerrupter 106, it will be understood that, depending upon the application of CRCD 10, microprocessor 20 could be programmed to accept the object as a valid, non-ferromagnetic coin upon photointerrupter 106 detecting the object at block 326, irrespective of the amount of time it takes the object to pass photointerrupter 106. Thus, in accordance with one aspect of the present invention, the method for detecting and counting non-ferromagnetic coins includes monitoring coin path 24 with FO sensor 16 for the presence therein of a ferromagnetic object and detecting the presence of an object with photointerrupter 106. If no ferromagnetic object is detected by FO sensor 16, but an object is detected by photointerrupter 106, then the object is accepted as a valid coin.

Additionally, although the foregoing process flow has been described for an object moving through only coin path 24, it will be understood that microprocessor 20 is preferably arranged to simultaneously and independently monitor both coin path 24 and coin path 24', using separate counters and counter flags for each path.

Figure 7:
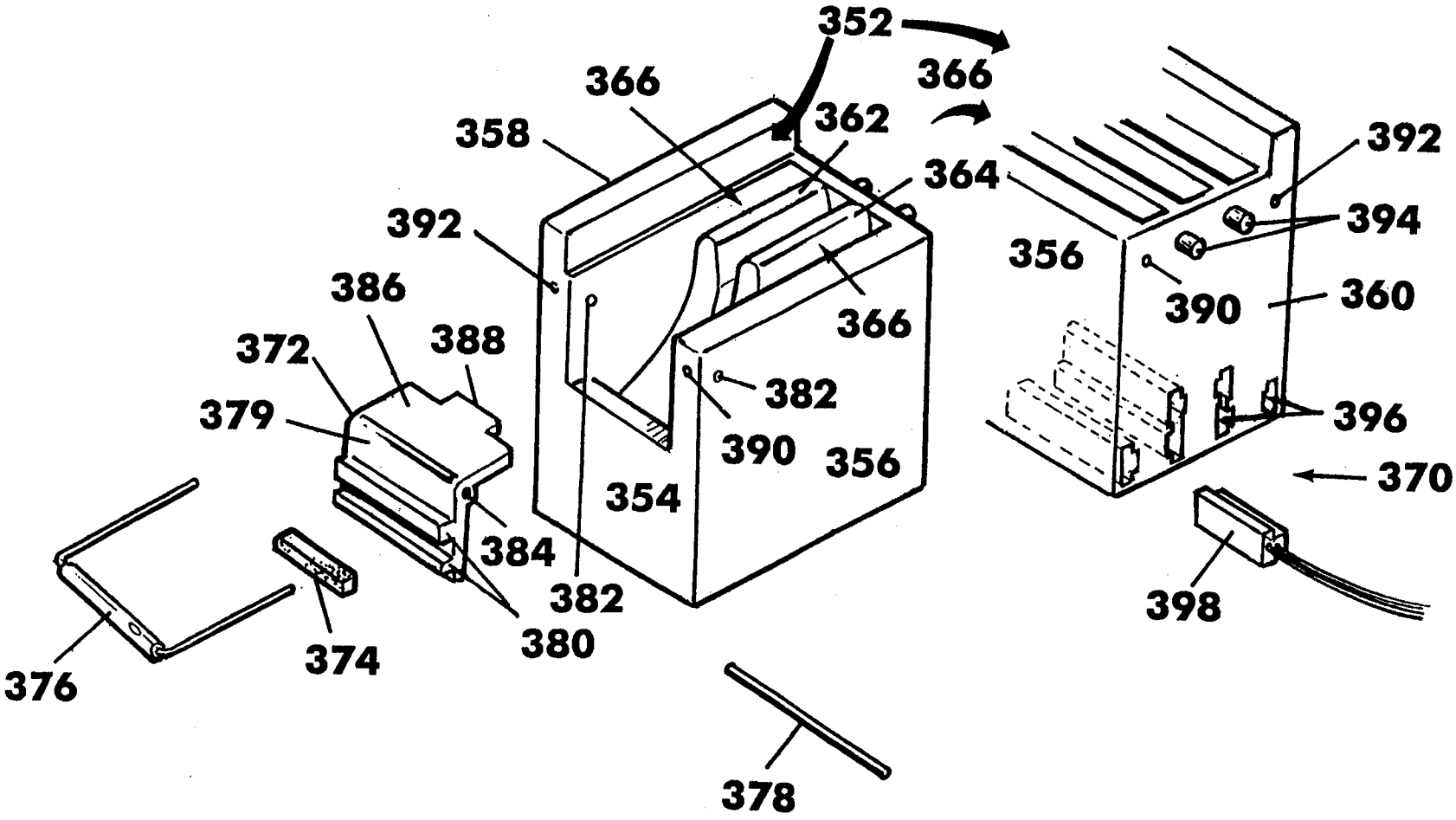
FIG. 7 is a perspective view of an opto-magnetic coin reader for use with a conventional coin separator and the recognition and counting circuit of FIG. 5.

FIG. 7 shows another embodiment of the present invention which comprises an opto-magnetic coin reader 350 which can be used with a conventional coin separator. These coin separators mechanically sort objects inserted into the vending machine by size, weight, and magnetic qualities. Coin reader 350 is specifically configured to operate in conjunction with a Coinco TM coin separator, as manufactured by Coin Excepters Inc. of St. Louis, Mo. However, it will of course be understood that coin reader 350 could be adapted to operate with other coin separators. As will be evident upon reading the description that follows, opto-magnetic coin reader 350 is an alternative embodiment of mode controller 14 and coin detector 18 that is designed to work in conjunction with a mechanical coin separator. Thus, coin reader 350, together with a conventional coin separator, can be used as a substitute for housing 50, mode controller 14, FO sensor 16, and coin detector 18.

The Coinco TM device separates nickels, dimes, and quarters, and drops them through separate chutes. Coin reader 350 is configured to be attached to the Coinco TM separator to receive the nickels, dimes, and quarters as they fall out of their respective chutes. Coin reader 350 includes a housing 352 having a front wall 354, two side walls 356, 358, and a back wall 360, which is shown in the rotated, partial view of housing 352 that is a part of FIG. 7. Housing 352 is substantially open on its top and bottom surfaces to allow coins exiting the coin separator to pass downwardly through housing 352 unhindered. Housing 352 also includes two internal walls 362, 364 that extend between front wall 354 and back wall 360 and that separate the interior of housing 352 into three coin paths 366, 366', and 366". These coin paths correspond with the exit openings in the quarter, dime, and nickel chutes of the coin separator. Thus, quarters fall through coin path 366, dimes through path 366', and nickels through path 366". Front wall 354 extends only partway up the front of housing 352 and interior walls 362, 364 do not extend into the front, top portion of housing 352 to provide clearance for pivotal movement of a flapper, as described below.

Coin reader 350 also includes a mode controller 368 and a coin detector 370, each of which operate in the same manner as mode controller 14 and coin detector 18 of CRCD 10, respectively. Mode controller 368 comprises a carrying member or flapper 372, a permanent magnet 374, a reed switch 376, and a pin 378 which is used to attach flapper 372 to housing 352. Flapper 372 includes a lower portion 379 having a pair of opposed, laterally extending walls 380 which form a channel that receives magnet 374. Flapper 372 is pivotally mounted to housing 352 via pin 378 which extends through a pair of holes 382 in side walls 356, 358 and through a hole 384 that extends laterally through flapper 372. The width of flapper 372 is slightly less than the distance between side walls 356 and 358 and the diameter of hole 384 is greater than the diameter of pin 378 so that flapper 372 is free to rotate about pin 378. Flapper 372 also includes a lever arm 386 that extends the width of flapper 372 and that has a length less than the distance between pin 378 and interior walls 362, 364 so that they will not interfere with rotation of flapper 372 about pin 378. Lever arm 386 has a rear edge 388 that is contoured to insure that quarters, dimes, and nickels falling through their respective coin paths 366, 366', and 366" will cause rotation of flapper 372 about pin 378.

The center of gravity of flapper 372 is spaced from the axis defined by hole 384 and is located on its lower portion 379 so that lever arm 386 is normally biased into coin paths 366, 366', and 366". Stated another way, the combined weight of magnet 374 and lower portion 379 of flapper 372 is greater than the weight of lever arm 386 so that lower portion 379 hangs downwardly and lever arm 386 extends horizontally into coin paths 366, 366', and 366". When biased in this manner, magnet 374 is located in its normal position. As will now be appreciated, a coin falling through any of the coin paths will contact lever arm 386, causing flapper 372 to pivot about hole 384, thereby moving magnet 374 from its normal position to an extended position.

Reed switch 376 is mounted by its leads to housing 352 in a position located remotely of the normal position of magnet 374, but near the extended position of magnet 374 so that the contacts of reed switch 376 are normally not closed, but will close upon magnet 374 moving from its normal position to its extended position. Reed switch 376 is mounted to housing 352 by its leads which extend through lengthwise apertures 390 and 392 in side walls 356 and 358, respectively, of housing 352. Reed switch 376 is then electrically connected to a printed circuit board (not shown) which is mounted on back wall 360 of housing 352. Posts 394 can be used to mate with corresponding holes in the printed circuit board (PCB) to properly align the PCB on back wall 360.

Back wall 360 has openings formed therein that provide access to cavities 396 formed in side walls 356, 358 and interior walls 362, 364. Cavities 396 are arranged such that each coin path has two opposing cavities 396, one of which receives a photo-transmitter and the other of which receives a photo-receiver. For example, a photo-transmitter 396 is shown oriented to be inserted into one of the cavities 396. As with photointerrupters 106, 106' of FIG. 3, the photo-transmitters shine light across their associated coin path which is received by the opposing photo-receiver in the absence of an opaque object therebetween. The photo-receivers include a solid state switch which closes upon the light being received. The photo-transmitters and receivers are mounted by their leads to the PCB located on back wall 360 of housing 352.

Coin reader 350 is coupled to coin recognition and counting circuit 12, which is modified somewhat to operate with coin reader 350. In particular, the circuitry used to detect activation of the coin return button is not needed and the ferromagnetic object recognition circuit 170, as well as the associated software needed to recognize and distinguish coins from other objects, is not needed, since the coin separator performs that function. Additionally, the program executed by microprocessor 20 is somewhat simplified, as discussed below. Coin reader 350 is coupled to circuit 12 by appropriate electrical connections between PCB 90 and the PCB mounted on back wall 360 of housing 352.

Figure 8:
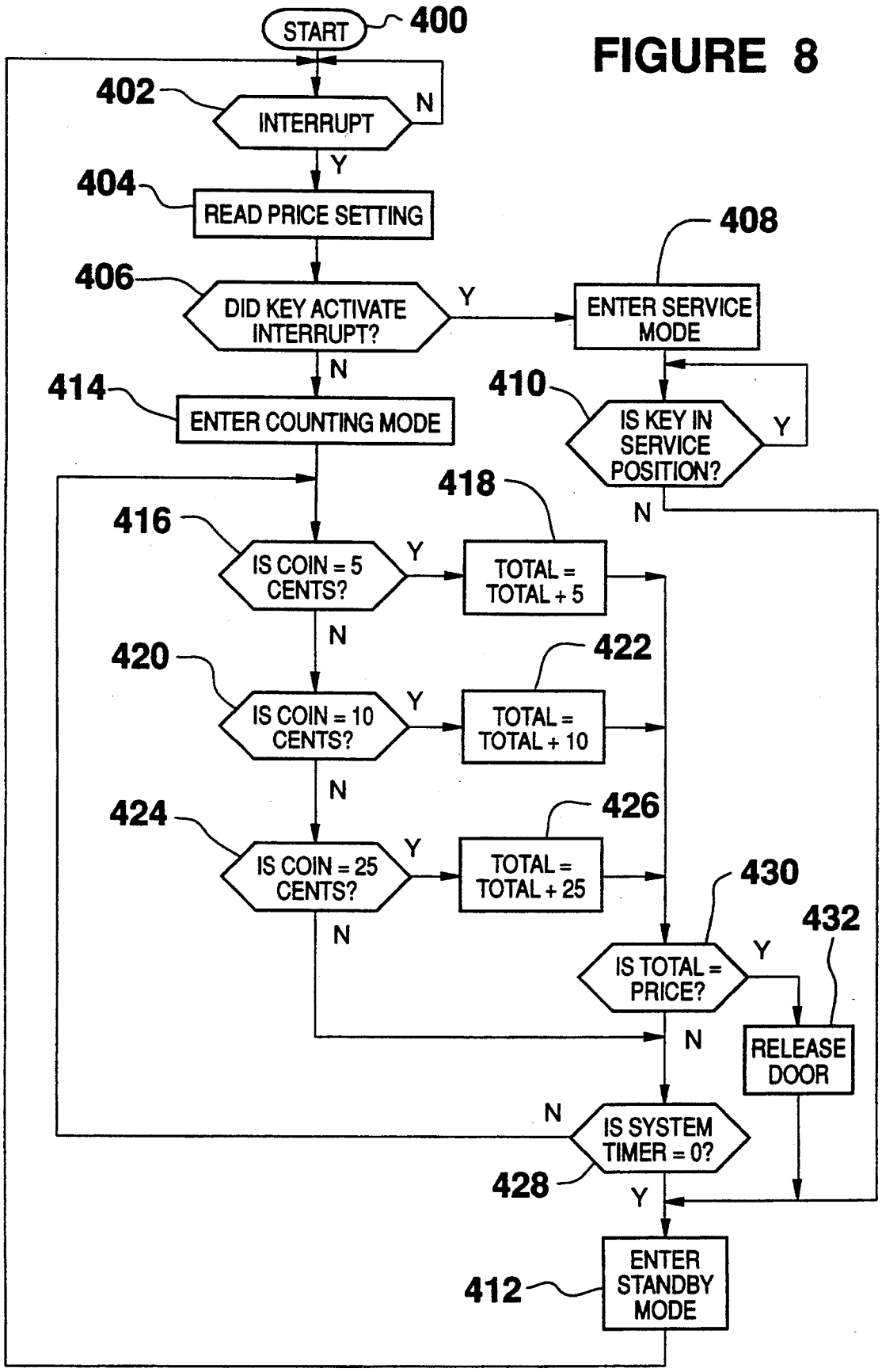
FIG. 8 is a flow chart showing the operation of the opto-magnetic coin reader of FIG. 7 with the recognition and counting circuit of FIG. 5.

Turning now to FIG. 8, the process flow of circuit 12, as configured to operate in conjunction with coin reader 350, will now be described. The process flow is initially identical to that discussed in connection with FIG. 6. Thus, process flow begins at start block 400, checks for an interrupt at block 402 and, if so, moves to block 404 to read in the price setting, and then to block 406 to determine whether or not the interrupt was generated by key switch 36 being moved to its service position. If so, the process flow remains identical to that discussed in connection with FIG. 6. That is, flow moves to block 408 where circuit 12 enters its service mode and then at block 410 waits until key switch is moved back out of its service position, after which it re-enters the standby mode at block 412 and returns to start block 400.

If, at block 406, microprocessor 20 determines that the interrupt was not due to key switch 36, then it knows that the interrupt was caused by a nickel, dime, or quarter exiting the coin separator and passing through coin reader 350. Thus, circuit 12 enters its counting mode at block 414 where the external interrupt is disabled and the system timer is begun. Flow then moves to block 416 at which the photo-receiver in coin path 366" is checked to determine if the coin is a nickel. If the photo-receiver indicates that an object is in coin path 366", then the user is credited with five cents at block 418 by adding five to a total (which is initially set to zero). If a nickel is not detected, then flow moves from block 416 to block 420 where the photo-receiver in coin path 366' is checked. If a dime is detected then the total is increased by ten at block 422. If a dime is not detected, then the flow instead moves to block 424 where the photo-receiver in coin path 366 is checked. If a quarter is detected then the total is increased by twenty-five at block 426 and, if not, then flow moves to block 428 where the system timer is checked. If the system timer has run out, then circuit 12 re-enters standby mode at block 412 and flow returns to start block 400. If the system timer has not timed out, then flow returns to block 416 to again check for a nickel. The flow will loop through blocks 416, 420, 424, and 428 until a coin is detected in one of the coin paths or the system timer runs out.

Once a nickel, dime, or quarter has been detected and added to the total, flow moves to block 430 where the total is compared to the price read in at block 404. If the total is less than the price, then flow moves to block 428 where the system timer is checked. If the system timer has timed out, circuit 12 enters its standby mode at which point the total is reset to zero. Flow then returns back to start block 400. If the timer has not yet run out then flow moves to block 416 and continues to loop through blocks 416, 420, 424, and 428 until another coin is detected or the system timer runs out. If, at block 430, the total is greater than or equal to the set price, then flow moves to block 432 where solenoid 40 is pulsed to release the vending machine door. Finally, flow then returns to start block 400 after entering the standby mode at block 412.

It should be noted that the processes carried out in blocks 416–426 correspond generally to those carried out in blocks 326, 328,330, and 332 of FIG. 6. However, since the coin separator separates nickels, dimes, and quarters from other objects and then drops them into separate coin paths of coin reader 350, the photo-receivers associated with each of those coin paths need only detect the presence of the coin to know that it is a nickel, dime, or quarter. Thus, no measurement of the time it takes the coin to pass the photo-receiver is required, nor is any comparison of that time with predetermined ranges of times needed, as is carried out in the process described in connection with FIG. 6.

It will thus be apparent that there has been provided in accordance with the present invention a coin recognition and counting circuit and a method therefor which achieves the aims and advantages specified herein. The terms used herein are for description only and are not to be interpreted in a limiting sense. Thus, for example, "coin" as used herein and in the attached claims can refer to U.S. coin currency, foreign currency, or tokens. Also, "magnet" refers to any element or elements that produce a magnetic field.

It will of course be understood that the foregoing description is of preferred exemplary embodiments of the invention and that the invention is not limited to the specific embodiments shown. Various changes and modifications will become apparent to those skilled in the art and all such variations and modifications are intended to come within the spirit and scope of the appended claims.

APPENDIX

RESISTORS

| REF. NO. | VALUE |
|---|---|
| 186 | 100K |
| 188 | 10K |
| 192 | 22K |
| 194 | 10K |
| 196 | 2K |
| 200 | 100K |
| 204 | 100K |
| 206 | 10K |
| 208a | 22K |
| 208b | 2K |
| 212 | 100 |
| 218 | 10K |
| 218' | 10K |
| 220 | 100K |
| 220' | 100K |
| 224 | 10K |
| 226 | 100K |

-continued

APPENDIX

| | |
|---|---|
| 232 | 10K |
| 244 | 100K |
| 246 | 10K |
| 258a | 150K |
| 258b | 270K |
| 260 | 470 |
| 264 | 100K |
| 272 | 10K |

DIODES

| REF. NO. | PART NO. |
|---|---|
| 172 | 1N4001 |
| 182 | 1N4148 |
| 198 | 1N4148 |
| 230 | IN4148 |
| 252 | 1N4001 |
| 268 | 1N4148 |
| 274 | 1N4148 |

CAPACITORS

| REF. NO. | VALUE |
|---|---|
| 176 | .1 μF |
| 178 | 10 μF |
| 184 | .01 μF |
| 222 | .01 μF |
| 222' | .01 μF |
| 228 | .01 μF |
| 266 | .01 μF |

TRANSISTORS

| REF. NO. | PART NO. |
|---|---|
| 190 | 2N3906 |
| 202 | 2N7000 |
| 210 | 2N3906 |
| 240 | 2N7000 |
| 256 | 2N7000 |

MISCELLANEOUS

| REF. NO. | PART NO. | MFG. |
|---|---|---|
| 20 | UP17104 | NEC |
| 96 | HSR-067 | HERMETIC SWITCH |
| 102 | HSR-003 | HERMETIC SWITCH |
| 102' | HSR-003 | HERMETIC SWITCH |
| 106 | OPB067L | OPTEC |
| 106' | OPB067L | OPTEC |
| 174 | TK1164 | TOKO |
| 242 | G5V-1 | OMRON |
| 276 | 8MHX RESON. | |

I claim:

1. An apparatus for electronically counting coins inserted into a coin operated machine, comprising:

a magnet movable from a first position to a second position in response to movement of a coin along a coin path;

a coin detector, said detector being disposed to detect the coin when it moves along said coin path; and a coin counting circuit having a standby mode and a counting mode, said circuit being operable to draw less power when in said standby mode than when in said counting mode and being responsive to said coin detector when in said counting mode to count the number of coins detected by said coin detector and, further, said circuit being operable, in response to said magnet moving between said first and second positions, to change from said standby mode to said counting mode.

2. An apparatus as defined in claim 1, wherein said circuit includes a magnetically responsive switch, said switch being disposed proximate said second position such that said switch changes its conductive state when said magnet moves between said first and second positions, and wherein said circuit is operable to change from said standby mode to said counting mode when said switch changes its conductive state.

3. An apparatus as defined in claim 1, wherein said circuit includes a microprocessor operable under program control to selectively place said circuit in said standby and counting modes, said microprocessor being operable in a quiescent state when said circuit is in said standby mode;

wherein said circuit is operable to generate an interrupt when said magnet moves from said first position to said second position and wherein said microprocessor is responsive to said interrupt to place said circuit in said counting mode.

4. An apparatus as defined in claim 3, wherein:

said circuit is powered by one or more batteries;

said coin detector comprises a photo-interrupter; and said microprocessor is operable to disable power to said photo-interrupter when said circuit is in said standby mode.

5. An apparatus as defined in claim 1, wherein said magnet is supported on a pivotally disposed carrying member having a 1ever arm that is pivotable into and out of said coin path, said magnet being in said first position when said lever arm is positioned in said coin path and being in said second position when said lever arm is positioned out of said coin path;

wherein said member is biased to pivot said lever arm into said coin path and wherein said lever arm is pivotable out of said coin path by a coin moving along said coin path to thereby move said magnet between said first and second positions.

6. An apparatus as defined in claim 5, wherein said carrying member includes a second lever arm that is pivotable into and out of a second coin path, said magnet being in said first position when said second lever arm is positioned in said second coin path and being in said second position when said second lever arm is positioned out of said second coin path;

wherein said member is biased to pivot said second lever arm into said second coin path and wherein said second lever arm is pivotable out of said second coin path by a coin moving along said second coin path to thereby move said magnet between said first and second positions.

7. An apparatus as defined in claim 5, wherein said carrying member is disposed to pivot about an axis and wherein the center of gravity of said carrying member is spaced from said axis such that said lever arm is biased into said coin path.

* * * * *